US006572332B2

(12) United States Patent
Harvey et al.

(10) Patent No.: US 6,572,332 B2
(45) Date of Patent: Jun. 3, 2003

(54) GAS TURBINE ENGINE AEROFOILS

(75) Inventors: Neil W Harvey, Derby (GB); Michael J Brear, Melbourne (AU); Howard P Hodson, Godmanchester (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 10/092,510

(22) Filed: Mar. 8, 2002

(65) Prior Publication Data

US 2002/0136639 A1 Sep. 26, 2002

(30) Foreign Application Priority Data

Mar. 21, 2001 (GB) ..... 0107058

(51) Int. Cl.[7] ..... F01D 5/14; F01D 9/04

(52) U.S. Cl. ..... 415/191; 416/228; 416/236 R; 415/208.2

(58) Field of Search ..... 416/228, 236 R, 416/237; 415/191, 208.1, 208.2

(56) References Cited

U.S. PATENT DOCUMENTS 4,108,573 A 8/1978 Wagner
4,809,764 A * 3/1989 Prasad ..... 164/122.1
5,151,014 A * 9/1992 Greenwald et al. ..... 416/237
5,169,290 A * 12/1992 Chou ..... 416/236 R
5,209,644 A * 5/1993 Dorman ..... 416/236 R
5,397,215 A * 3/1995 Spear et al. ..... 415/191

FOREIGN PATENT DOCUMENTS

| | | | |
|---|---|---|---|
| GB | 223552 | P | 6/1925 |
| GB | 478104 | P | 1/1938 |
| GB | 840543 | P | 7/1960 |
| GB | 996041 | P | 6/1965 |
| GB | 1262182 | P | 2/1972 |
| GB | 1291927 | P | 10/1972 |
| GB | 1366924 | P | 9/1974 |
| WO | WO91/00212 | A | 1/1991 |

* cited by examiner

*Primary Examiner*—Christopher Verdier
(74) *Attorney, Agent, or Firm*—W. Warren Taltavull; Manelli, Denison & Selter, PLLC

(57) ABSTRACT

An aerofoil (34) for a gas turbine engine is substantially solid, including a concave pressure surface (42) and a convex suction surface (40). The pressure surface (42) is provided with a projection in the form of an elongate fin (44) which extends in the radial direction of the aerofoil.

11 Claims, 3 Drawing Sheets

PRIOR ART

GAS TURBINE ENGINE AEROFOILS

The invention relates to gas turbine engine aerofoils and particularly to aerofoils for stators and rotors in the low pressure turbine of an aero engine.

Low pressure turbine aerofoils generally do not require any provision to be made in the aerofoil shape for the inclusion of a cooling system. This is because the low pressure aerofoils operate in an environment which is relatively cool compared to that of the intermediate and high pressure aerofoils.

One known design of low pressure aerofoil is referred to as "thick hollow". The aerofoil is manufactured using a lost wax process in which wax aerofoils are produced in a master dye with a ceramic core within the wax. A shell is formed about the wax and molten metal injected into the shell at locations along the span of the aerofoil. After casting, the ceramic core within the metal aerofoil is leached out leaving much of the aerofoil with a very thin wall section and therefore achieving minimum weight. In some cases the wall section is the minimum required for mechanical (stress) reasons.

The low weight of thick hollow aerofoils is highly advantageous. However, there are two drawbacks with the above manufacturing process. Firstly, the use of a ceramic core significantly adds to the cost of manufacture. Secondly, injection into the mould results in "gates" of excess metal standing out from the aerofoil surface, which have to be dressed by an additional machining operation. The steps or discontinuities in the surface that are left may result in loss of aerodynamic performance. In order that the gates may be accessed for removal, they are required to lie on the convex suction surface of the aerofoil, whose shape is much more critical to its aerodynamic performance than is the shape of the pressure side.

An alternative design of low pressure aerofoil is referred to as "thin solid". The manufacturing process is generally similar to that for thick hollow aerofoils. However, there is no ceramic core and the metal is injected into the mould from the ends of the aerofoil. This prevents the formation of unwanted gates on the aerofoil surface. However, there is a drawback in that the aerofoil must be of sufficient thickness to allow the metal to flow fully to the mid-span section of the aerofoil. This thickness is greater than that needed for mechanical reasons (i.e. to have acceptably low stresses) and as a result the aerofoil is heavier than necessary, and certainly heavier than a thick hollow version of the aerofoil.

According to the invention there is provided an aerofoil for a gas turbine engine, the aerofoil being substantially solid and including a concave pressure surface and a convex suction surface, wherein the pressure surface is provided with a projection extending therefrom.

Preferably the aerofoil is elongate and is adapted to be oriented in a generally radial direction of the gas turbine engine and the projection comprises an elongate fin extending in the radial direction of the aerofoil. The elongate fin preferably extends substantially along a whole radial span of the aerofoil.

The aerofoil may have a varying cross-sectional thickness, being thicker in a central region thereof and tapering towards its edges and the projection may extend from the pressure surface at a central, relatively thick region of the aerofoil. The projection may extend from the pressure surface in a direction substantially perpendicular to a tangent to that surface.

The aerofoil may include radially extending leading and trailing edges joined by the pressure and suction surfaces and a disturbed flow region defined between the aerofoil pressure surface and a plane extending tangentially to a pressure side of the leading edge. The projection is preferably located fully within the disturbed flow region. The projection may extend from the pressure surface across between 25% and 100% of the disturbed flow region.

Preferably a cross-sectional thickness of the projection is at least equal to a minimum cross-sectional thickness of the aerofoil.

The cross-sectional thickness of the projection may be substantially uniform. Alternatively, the cross-sectional thickness of the projection may decrease from a proximal to a distal part thereof.

The aerofoil may form part of a low pressure turbine or stator blade for a gas turbine engine.

According to the invention there is further provided a gas turbine engine including an aerofoil according to any of the preceding definitions.

According to the invention there is further provided a method of casting an aerofoil according to any of the preceding definitions, the method including the step of injecting metal into a casting shell via the projection.

An embodiment of the invention will be described for the purpose of illustration only, with reference to the accompanying drawings, in which.

Figure 1:
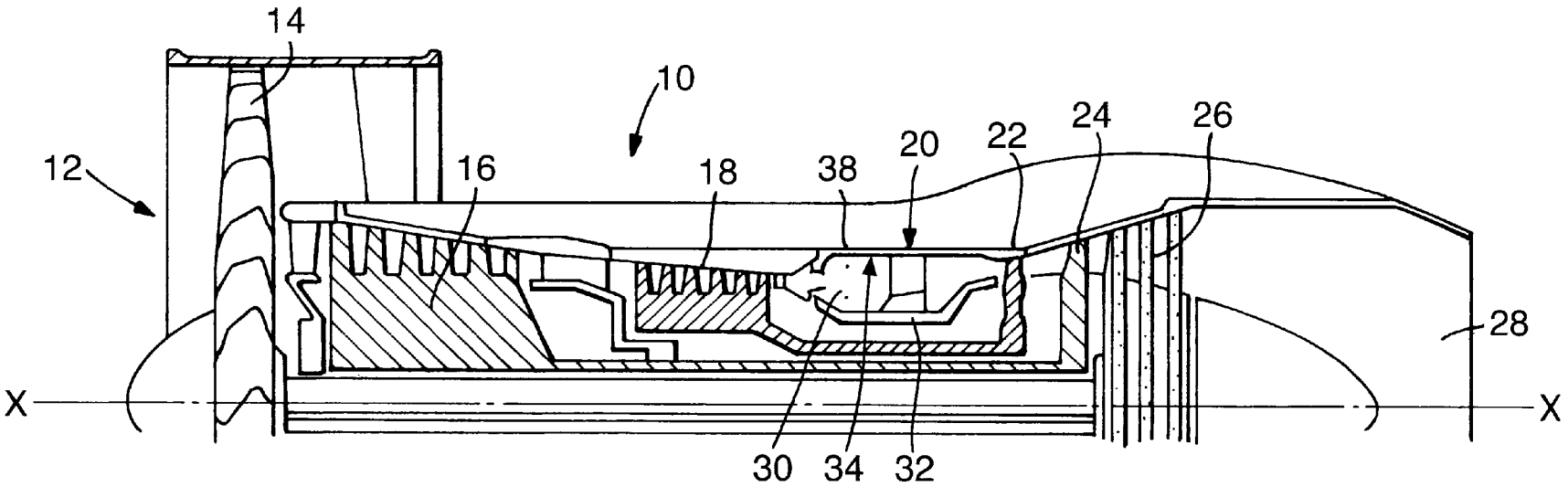
FIG. 1 is a diagrammatic sectional view of a ducted fan gas turbine engine.

With reference to FIG. 1 a ducted fan gas turbine engine generally indicated at 10 comprises, in axial flow series, an air intake 12, a propulsive fan 14, an intermediate pressure compressor 16, a high pressure compressor 18, combustion equipment 20, a high pressure turbine 22, an intermediate pressure turbine 24, a low pressure turbine 26 and an exhaust nozzle 28.

The gas turbine engine 10 works in the conventional manner so that air entering the intake 12 is accelerated by the fan 14 to produce two air flows, a first air flow into the intermediate pressure compressor 16 and a second airflow which provides propulsive thrust. The intermediate pressure compressor 16 compresses the air flow directed into it before delivering the air to the high pressure compressor 18 where further compression takes place.

The compressed air exhausted from the high pressure compressor 18 is directed into the combustion equipment 20 where it is mixed with fuel and the mixture combusted. The resultant hot combustion products then expand through and thereby drive the high, intermediate and low pressure turbines 22, 24 and 26 before being exhausted through the nozzle 28 to provide additional propulsive thrust. The high, intermediate and low pressure turbines 22, 24 and 26 respectively drive the high and intermediate pressure compressors 16 and 18 and the fan 14 by suitable interconnecting shafts.

Figure 2A:
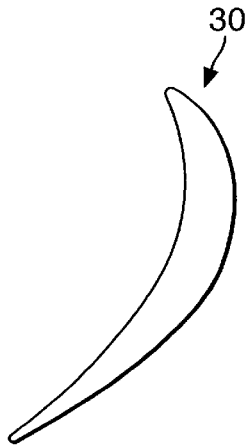
FIGS. 2A and 2B are diagrammatic sectional views of known thin solid and thick hollow aerofoils respectively.
Figure 2B:
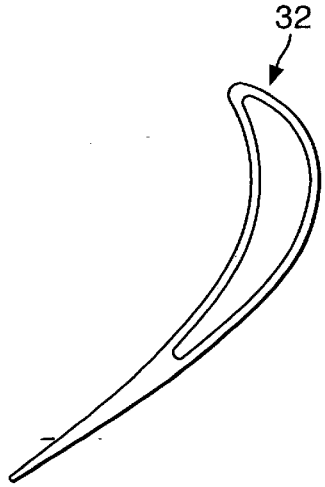
PRIOR ART Fig.2B.

Referring to FIGS. 2A and 2B, there are illustrated two known aerofoils suitable for the low pressure turbine 26 of the gas turbine engine 10. The aerofoil 30 of FIG. 2A is of the thin solid type and the aerofoil 32 of FIG. 2B is of the thick hollow type. It may be seen that the thin solid blade includes a significantly greater amount of metal and therefore is significantly heavier than the thick hollow aerofoil 32.

Figure 3:
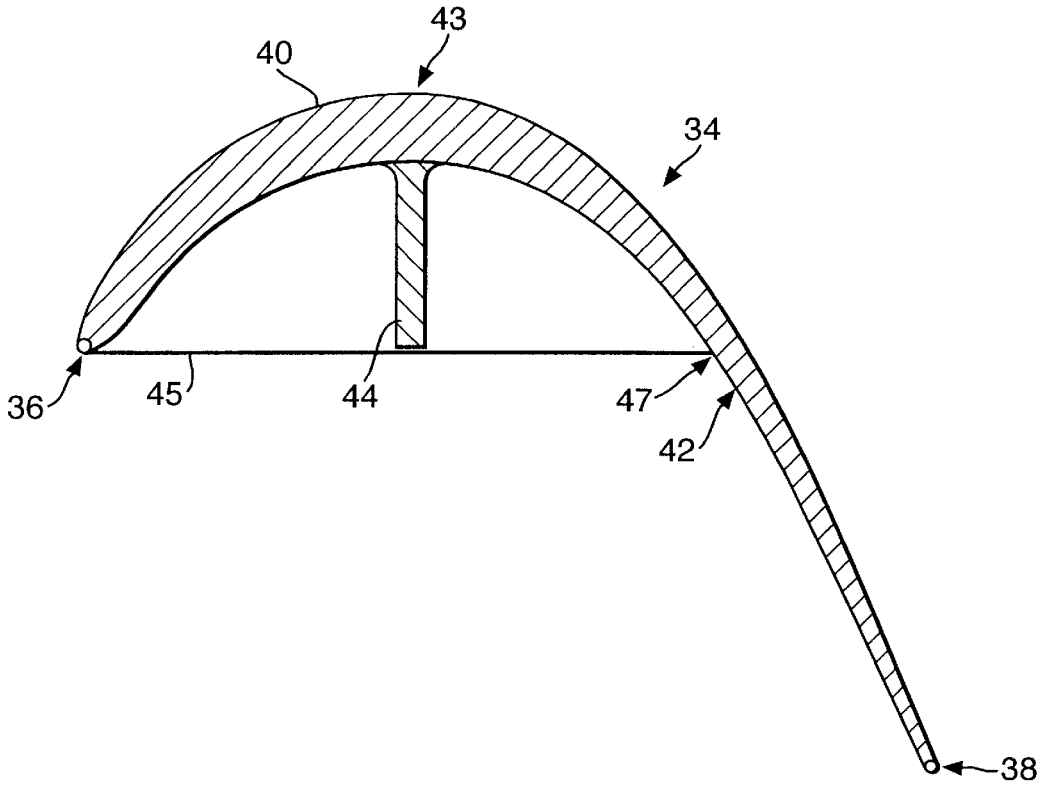
PRIOR ART Fig.3.
FIG. 3 is a diagrammatic sectional view of an aerofoil according to a first embodiment of the invention.

Referring to FIG. 3, there is illustrated an aerofoil 34 according to the invention, suitable for a low pressure turbine. The aerofoil 34 is elongate and is designed to be oriented radially of the gas turbine engine 10. FIG. 3 is a cross-section through the elongate aerofoil.

The aerofoil 34 includes a leading edge 36 and a trailing edge 38. A convex suction surface 40 extends between the leading and trailing edges 36 and 38 on a low pressure side of the aerofoil 34 and a concave pressure surface extends between the leading and trailing edges 36 and 38 on a high pressure side of the aerofoil 34. The cross sectional thickness of the aerofoil varies, as the aerofoil tapers towards the trailing edge 38 and is thicker near the leading edge 36. The thickest part of the aerofoil is in a mid region 43.

Projecting from the concave pressure surface 42 of the aerofoil 34 is a fin 44. The fin 44 projects from the mid region 43 of the aerofoil 34, and runs along the whole radial span of the aerofoil. The fin 44 is of a substantially uniform thickness along its length.

The fin 44 projects towards or up to, but not beyond, a line 45 drawn at a tangent to the pressure side of the leading edge 36 and running axially until it intersects the later part of the pressure surface 42 at a point 47. The significance of this line is explained below.

The aerofoil between the leading edge 36 and the point 47 forms an arc. The fin 44 projects approximately from a central region of the arc.

The presence of the fin 44 provides significant advantages in the manufacturing process for the aerofoil 34, as follows.

The aerofoil 34 is manufactured by casting and, during the manufacturing process metal is injected into the shell via the fin 44. This means that the maximum flow path for the injected metal is short compared with the path of metal when injection takes place from the ends of the aerofoil and is currently performed for thin solid aerofoil blades. This enables the aerofoil to be thinner, and thus lighter, than is conventionally the case.

In addition, since the fin 44 is radially continuous, it is itself radially load bearing in use. It will therefore provides part of the useful cross-sectional area of the aerofoil, thus allowing the rest of the aerofoil to be proportionately thinner.

Prior to the recent development work carried out by the applicants, the use of a fin on the pressure side of an aerofoil was considered unacceptable because it was expected to cause significant aerodynamic spoiling and loss of performance. Machining the fin off completely would not be possible because of the difficulty of gaining access to the concave hollow formed by the shape of the aerofoil pressure side.

However, the applicants have established that a fin on the aerofoil pressure side has only a small aerodynamic penalty. The reasons for this are as follows.

Figure 5:
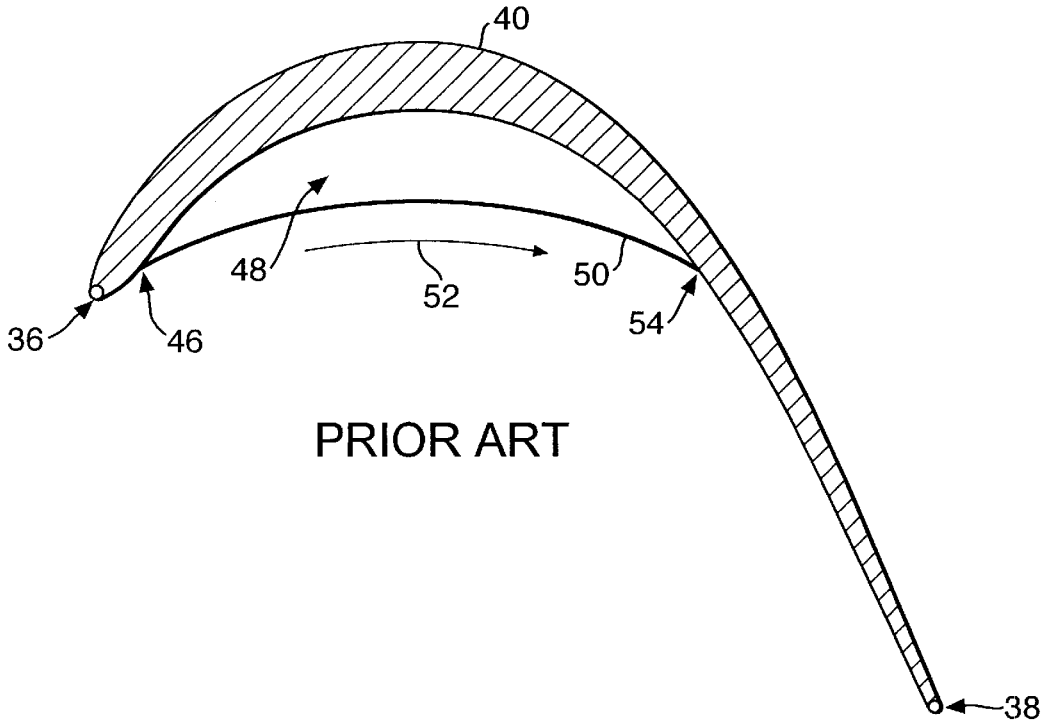
FIG. 5 is a diagrammatic sectional view of a prior art thin solid aerofoil illustrating the airflow over the aerofoil.

Particularly with relatively thin aerofoils, there is strong diffusion of the airflow on the early pressure surface after the leading edge. This results in separation of the boundary layer on the pressure surface and formation of a separation bubble. This is illustrated in FIG. 5, where the pressure surface boundary layer separates approximately at point 46. There is thus formed a highly disturbed, recirculating flow region within a separation bubble 48. The edge of the separation bubble is illustrated at 50, with free stream flow (indicated by the arrow 52) occurring outside that edge 50. At point 54, the separation bubble re-attaches to the pressure surface and a new pressure side boundary layer forms.

It has been found that if the fin 44 lies fully within the separation bubble 48, the fin causes minimal aerodynamic spoiling, since the flow within the separation bubble is already highly disturbed. The flow velocities in this region are low and thus the local loss generation is low.

FIG. 3 illustrates the maximum fin size which is likely to be possible. The maximum extent of the region that could be occupied by the pressure side separation bubble 48 is defined by the line 45 drawn at a tangent to the pressure side of the leading edge 36 and running axially until it intersects the later part of the same pressure surface 42. The relatively thick mid part 43 of the aerofoil 34 from which the fin 44 projects corresponds to the part of the surface 42 which is remote from the line 45.

A fin that extends from the pressure surface 42 to the line 45 is classed as a "full size" fin. In this case, the end of the fin is not obscured by the rest of the aerofoil and dressing off any gate material left after casting is very easy.

If the separation bubble 48 is smaller, then a shorter fin is used. Typically the fin will extend out from the aerofoil surface between 25% and 100% of the separation bubble height. However, the minimum length of the fin is limited by the need to gain access to its end, to dress off any gate material. If this minimum length is such that the fin would extend outside of the separation bubble 48, then the application of the fin is not appropriate.

Figure 4:
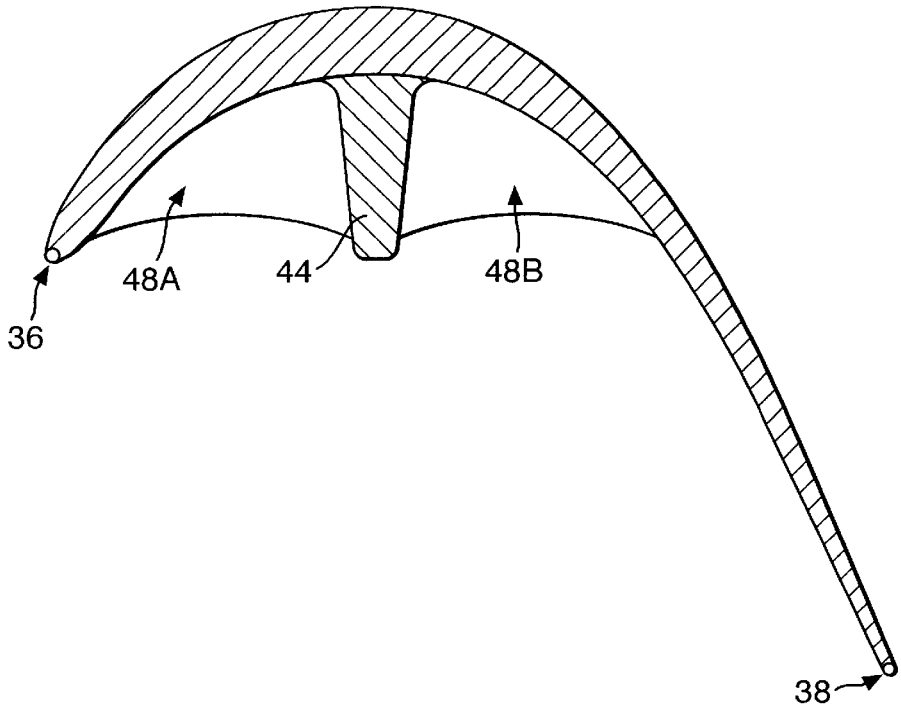
FIG. 4 is a diagrammatic sectional view of an aerofoil according to a second embodiment of the invention.

The fin illustrated in FIG. 3 has a substantially uniform thickness from its distal to its proximal end. An alternative embodiment is illustrated in FIG. 4, where a tapered fin 44 is thicker at its proximal end than at its distal end. FIG. 4 illustrates two separation bubbles, the first separation bubble 48A being located upstream of the fin 44 and a second separation bubble 48B being located downstream of the fin 44.

In both the FIG. 3 and the FIG. 4 embodiment, the minimum cross sectional dimension of the fin 44 is not less than the minimum cross sectional dimension of any other part of the aerofoil (usually the leading or trailing edge thickness).

The above described embodiments of the invention allow a thin solid aerofoil to be cast to the mechanically minimum thickness, thus giving the same weight as thick hollow blading but without the extra cost of a ceramic core and without the need to machine off gate material. The mechanically minimum thickness may also be reduced, as the fin 44 is radially weight bearing.

Various modifications may be made to the above described embodiment without departing from the scope of the invention. The shape of the fin may be modified as may its location, provided that it projects from the pressure surface and is located within the separation bubble.

We claim:

1. An aerofoil for a gas turbine engine, the aerofoil being substantially solid and including a concave pressure surface and a convex suction surface, wherein the pressure surface is provided with a projection extending therefrom, said aerofoil being elongate and adapted to be oriented in a generally radial direction of the gas turbine engine and wherein the projection comprises an elongate fin extending in the radial direction of the aerofoil.

2. An aerofoil according to claim 1 wherein the elongate fin extends substantially along a whole radial span of the aerofoil.

3. An aerofoil according to claim 1, wherein the aerofoil has a varying cross-sectional thickness, being thicker in a central region thereof and tapering towards its edges and wherein the projection extends from the pressure surface at a central, relatively thick region of the aerofoil.

4. An aerofoil according to claim 1 wherein the projection extends from the pressure surface in a direction substantially perpendicular to a tangent to that surface.

5. An aerofoil according to claim 1, the aerofoil including radially extending leading and trailing edges joined by the pressure and suction surfaces and a disturbed flow region defined between the aerofoil pressure surface and a plane extending tangentially to a pressure side of the leading edge, and wherein the projection is located fully within the disturbed flow region.

6. An aerofoil according to claim 5 wherein the projection extends from the pressure surface across between 25% and 100% of the disturbed flow region.

7. An aerofoil according to claim 1 wherein a cross-sectional thickness of the projection is at least equal to a minimum cross-sectional thickness of the aerofoil.

8. An aerofoil according to claim 1 wherein a cross-sectional thickness of the projection is substantially uniform.

9. An aerofoil according to claim 1 wherein a cross-sectional thickness of the projection decreases from a proximal to a distal part thereof.

10. An aerofoil according to claim 1 wherein the aerofoil forms part of a low pressure turbine or stator blade for a gas turbine engine.

11. A method of casting an aerofoil according to claim 1, the method including the step of injecting metal into a casting shell via the projection.

* * * * *